United States Patent [19]

Payne

[11] 4,392,034

[45] * Jul. 5, 1983

[54] ELECTRICAL SWITCH CONSTRUCTION

[75] Inventor: Frank Payne, Knoxville, Tenn.

[73] Assignee: Robertshaw Controls Company, Richmond, Va.

[ * ] Notice: The portion of the term of this patent subsequent to Nov. 2, 1999, has been disclaimed.

[21] Appl. No.: 241,004

[22] Filed: Mar. 6, 1981

Related U.S. Application Data

[63] Continuation-in-part of Ser. No. 187,498, Sep. 15, 1980, Pat. No. 4,357,589.

[51] Int. Cl.[3] ..... H01H 35/34

[52] U.S. Cl. ..... 200/81.4; 200/83 J; 200/83 P; 200/153 LA

[58] Field of Search ..... 337/306, 310, 315, 317, 337/318, 409; 200/84.4, 83 R, 83 J, 83 P, 83 B, 83 S, 83 SA, 67 B, 159 A, 153 LA, 18, 67 R, 244

[56] References Cited

U.S. PATENT DOCUMENTS

| | | | |
|---|---|---|---|
| 2,978,555 | 4/1961 | Jones | 200/67 G |
| 3,294,931 | 12/1966 | Lanza | 200/67 B |
| 3,535,480 | 10/1970 | Bahniuk | 200/83 P |
| 3,573,409 | 4/1971 | Jeffrey | 200/81.4 |
| 4,272,660 | 6/1981 | Mayer | 200/83 P |

*Primary Examiner*—G. P. Tolin

*Attorney, Agent, or Firm*—Candor, Candor & Tassone

[57] ABSTRACT

An electrical switch construction having a one-piece substantially U-shaped flexible member having a cross member and a pair of legs extending from the cross member and defining pivot points that pivotally mount pivot members to the construction. The legs respectively have cam followers intermediate the pivot points thereof and the cross member thereof. A plunger is axially movable between the legs and has a cam that serially engages the cam followers to serially flex the legs and thereby move the pivot points thereof to cause the pivot members to serially pivot as the plunger is axially moved in one direction.

12 Claims, 9 Drawing Figures

ELECTRICAL SWITCH CONSTRUCTION

CROSS-REFERENCE TO RELATED PATENT APPLICATION

This patent application is a Continuation-In-Part patent application of the applicant's copending parent patent application, Ser. No. 187,498, filed Sept. 15, 1980, now U.S. Pat. No. 4,357,589, both applications being assigned to the same assignee.

BACKGROUND OF THE INVENTION

1. Field of the Invention

This invention relates to an improved electrical switch construction and to a method of making the same.

2. Prior Art Statement

It is known to provide a temperature responsive electrical switch construction having electrical contact means operated by the stem means of a piston and cylinder type thermal device carried by the construction.

For example, see the following United States patent:

(1) U.S. Patent to Payne, No. 3,960,124

It appears that the stem means of the piston and cylinder type thermal device of item (1) above operates only one electrical switch means when a predetermined temperature is sensed by the thermal device.

It is also known to operate the electrical contact means of an electrical switch construction with a vacuum operated device.

It is also known to provide an electrical switch construction having electrical contact means operated by an axially movable plunger means carried by the construction, the contact means comprising a plurality of pairs of cooperating contacts arranged to have each cooperating pair thereof operated serially by the plunger means as the plunger means axially moves between the cooperating pairs of contact means. Each pair of such cooperating contacts comprises a fixed contact and a movable contact with each movable contact being snap acting and with each movable contact having a pivot member pivotally mounted to the construction.

For example, see the following U.S. Patent:

(2) U.S. Patent to Jeffrey et al, No. 3,573,409.

It is also known to provide an electrical switch construction having a one-piece substantially U-shaped flexible member having a cross member and a pair of legs extending from the cross member and defining pivot means that pivotally mount pivot members to the construction.

For example, see the following U.S. Patent:

(3) U.S. Patent to Lanza, No. 3,294,931.

SUMMARY OF THE INVENTION

It is one feature of this invention to provide an improved electrical switch construction.

In particular, it was found according to the teachings of the invention set forth in applicant's copending parent patent application, Ser. No. 187,498, filed Sept. 15, 1980, that the stem means that is operated by a piston and cylinder type thermal device can serially operate a plurality of electrical switches at different temperatures sensed by the thermal device.

Subsequently, it was found according to the teachings of this invention that such an electrical switch arrangement could be pneumatically operated by a pneumatically operated device so that the plurality of electrical switches can be serially operated by different predetermined pneumatic signals being directed to the pneumatically operated device.

For example, one embodiment of this invention provides an electrical switch construction having electrical contact means operated by an axially movable plunger means of a device carried by the construction, the contact means comprising a plurality of pairs of cooperating contacts arranged to have each cooperating pair thereof operated by the plunger means as the device axially moves the plunger means in one direction. Each pair of cooperating contacts comprises a fixed contact and a movable contact, each movable contact having a pivot member pivotally mounted to the construction. A one-piece substantially U-shaped flexible member has a cross member and a pair of legs extending from the cross member and defining pivot means that pivotally mount the pivot members to the construction. The legs respectively have cam follower means intermediate the pivot means thereof and the cross member. The plunger means is axially movable between the legs and has cam means serially engageable with the follower means to serially flex the legs and thereby move the pivot means thereof to cause the pivot members to serially pivot as said plunger means is axially moved by the device in the one direction thereof.

Accordingly, it is an object of this invention to provide an improved electrical switch construction having one or more of the novel features of this invention as set forth above or hereinafter shown or described.

Another object of this invention is to provide a method of making such an electrical switch construction, the method of this invention having one or more of the novel features of this invention as set above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
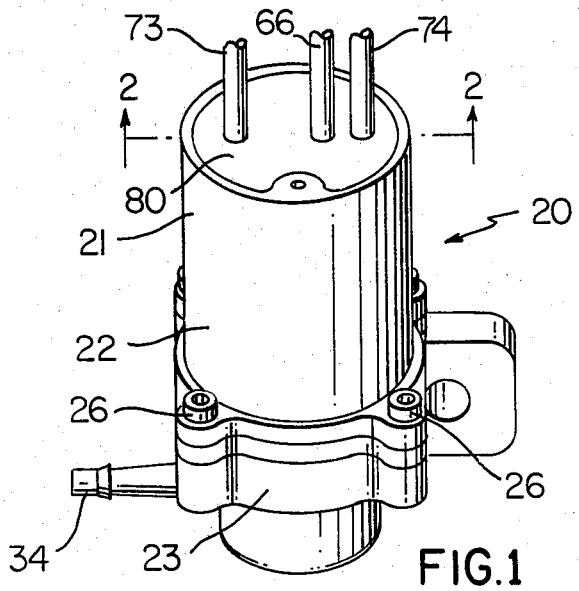
FIG. 1 is a perspective view of the improved pneumatically operated electrical switch construction of this invention.

While the various features of this invention are hereinafter described and illustrated as being particularly adapted to provide an electrical switch construction that is operated by a vacuum operated device, it is to be understood that the various features of this invention can be utilized singly or in any combination thereof to provide an electrical switch construction that can be operated by fluid pressure, as desired.

Therefore, this invention is not to be limited to only the embodiment illustrated in the drawings, because the drawings are merely utilized to illustrate one of the wide variety of uses of this invention.

Figure 2:
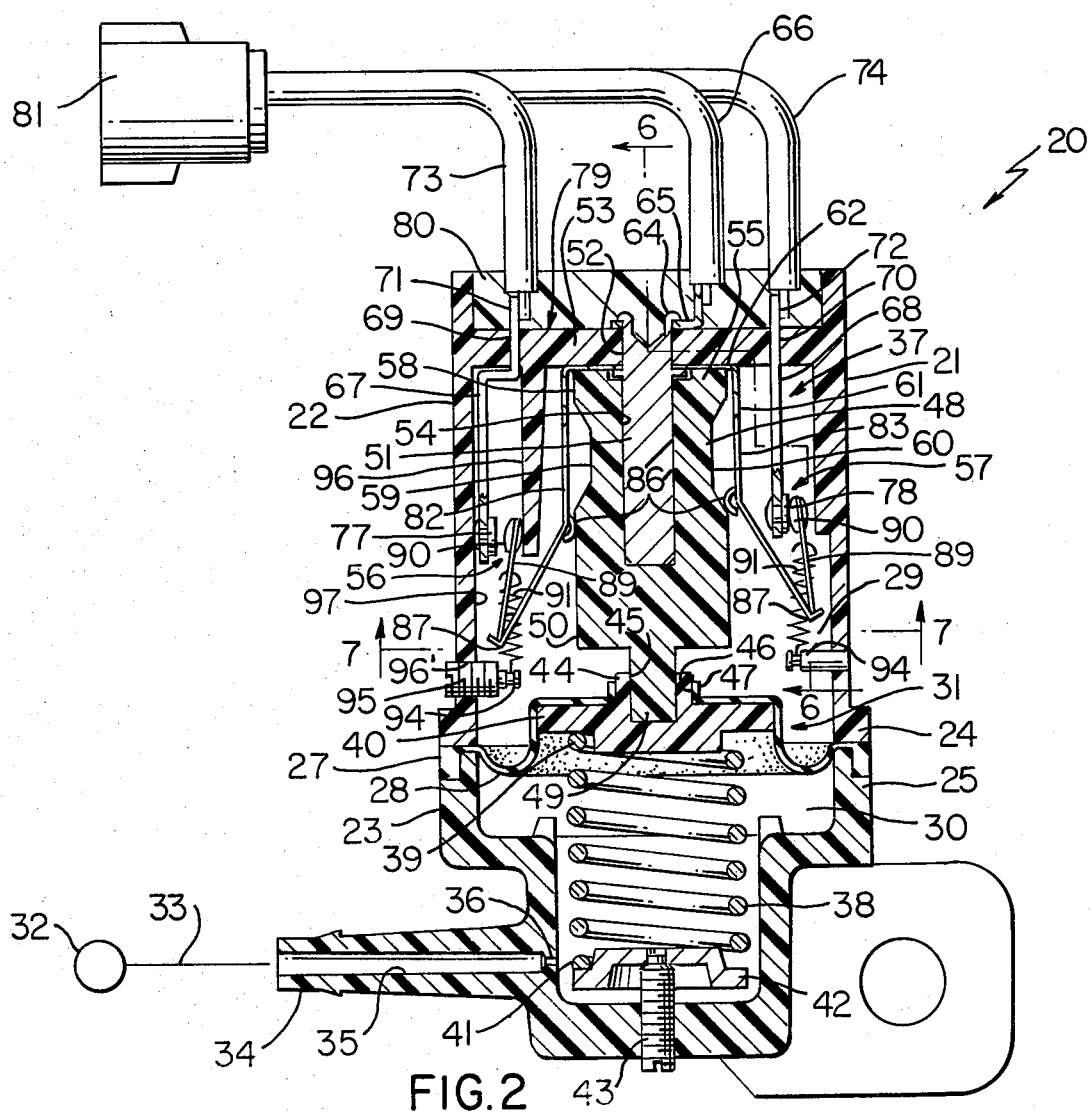
FIG. 2 is an enlarged cross-sectional view taken on line 2—2 of FIG. 1.

Referring now to FIGS. 1 and 2, the improved pneumatically operated electrical switch construction of this invention is generally indicated by the reference numeral 20 and comprises a housing means 21 formed of a pair of cup-shaped housing parts 22 and 23 respectively having their open ends 24 and 25 secured together by suitable fastening means 26 and trapping an outer peripheral portion 27 of a flexible diaphragm 28 therebetween whereby the diaphragm 28 cooperates with the cup-shaped housing parts 22 and 23 to define a pair of chambers 29 and 30 therein that are sealed from each other by the flexible diaphragm 28.

While the housing means 21 can be formed of any suitable material, the same is formed from electrically insulating material, such as plastic material molded into the configurations illustrated in the drawings.

The flexible diaphragm 28 and the chamber 30 cooperate with the housing part 23 to define a pneumatically operated portion or device of the construction 20 that is generally indicated by the reference numeral 31 and, in the embodiment illustrated in the drawings, comprises a vacuum operated device wherein a vacuum is adapted to be imposed in the chamber 30 by a suitable vacuum source means 32, FIG. 2, being interconnected by suitable conduit means 33 to an outwardly directed nipple 34 of the housing part 23 having a passage means 35 therein. The passage means 35 is fluidly interconnected to the chamber 30 through a restriction means 36 so that different vacuum signals can be imposed in the chamber 30 to operate an electrical switch portion of the construction 20 that is generally indicated by the reference numeral 37 and will be hereinafter described.

A compression spring 38 is disposed in the chamber 30 and has one end 39 bearing against a rigid backup member 40 carried by the diaphragm 28 and another end 41 bearing against an adjustable spring retainer 42 that is carried by a threaded adjusting member 43 so that the force of the compression spring 38 acting upwardly on the diaphragm 28 in FIG. 2 can be adjusted by the threaded adjusting member 43 in a manner well known in the art.

The diaphragm backup member 40 has a tubular portion 44 provided with an opening 45 therein, the tubular portion 44 projecting through a central opening 46 in the diaphragm 28 and being sealed to the inner peripheral portion 47 of the diaphragm 28 in any suitable manner.

A plunger means 48 is adapted to be disposed in the chamber 29 and has a reduced cylindrical projection 49 at one end 50 thereof that is received in the opening 45 of the tubular portion 44 of the rigid diaphragm backup member 40 and is secured therein in any suitable manner so that the plunger means 48 will be axially moved in the chamber 29 as the diaphragm 28 is moved under the influence of the particular vacuum signal being imposed in the chamber 30 in a manner hereinafter set forth.

Figure 3:
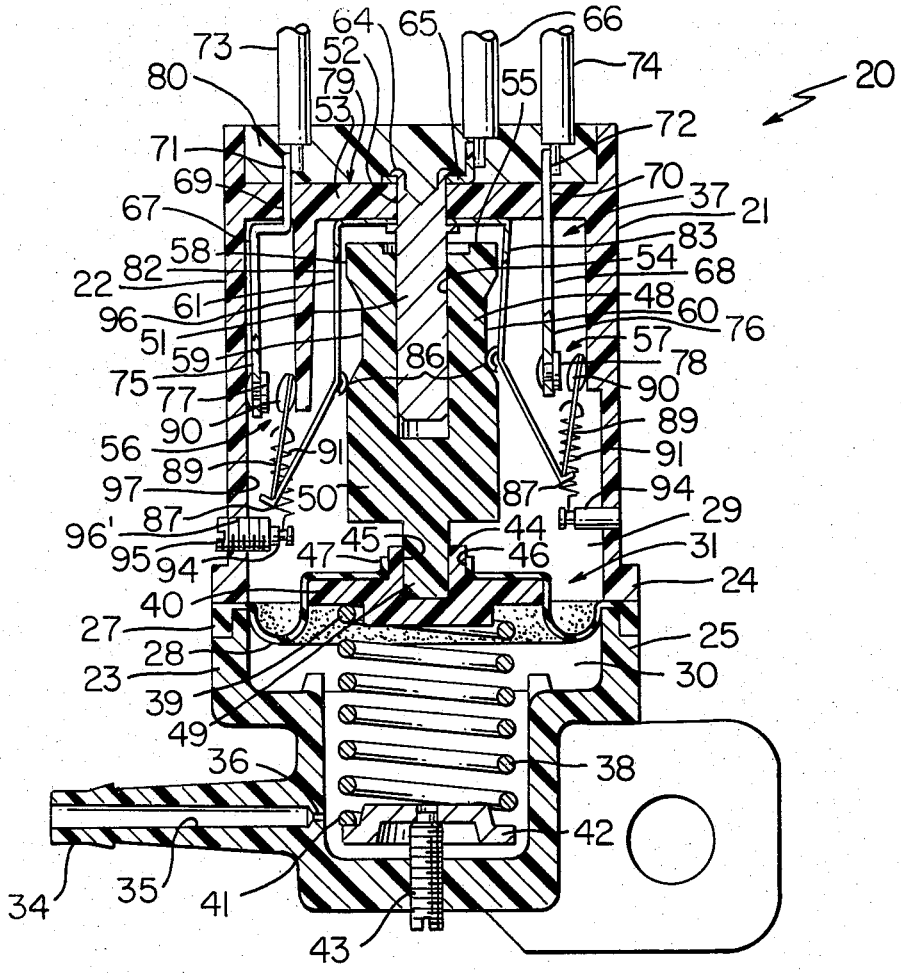
FIG. 3 is a view similar to FIG. 2 and illustrates the pneumatically operated electrical switch construction in another operating condition thereof.
Figure 6:
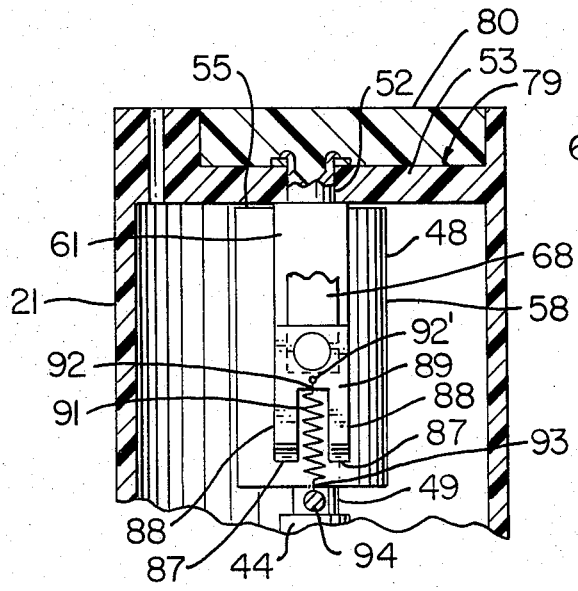
FIG. 6 is a fragmentary cross-sectional view taken substantially on the line 6—6 of FIG. 2.
Figure 7:
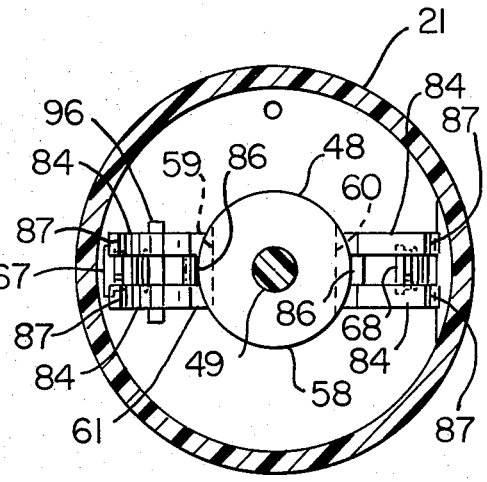
FIG. 7 is a cross-sectional view taken on the line 7—7 of FIG. 2.
Figure 5:
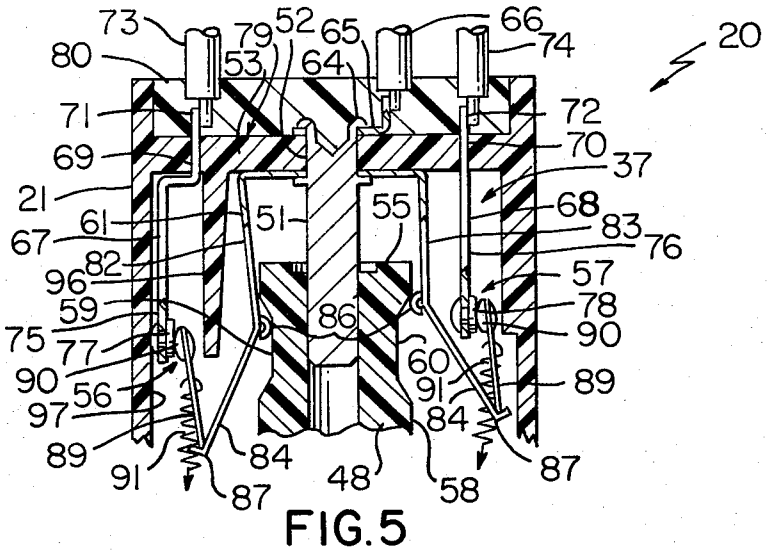
FIG. 5 is a view similar to FIG. 4 and illustrates the pneumatically operated electrical switch construction in still another operating condition thereof.
Figure 4:
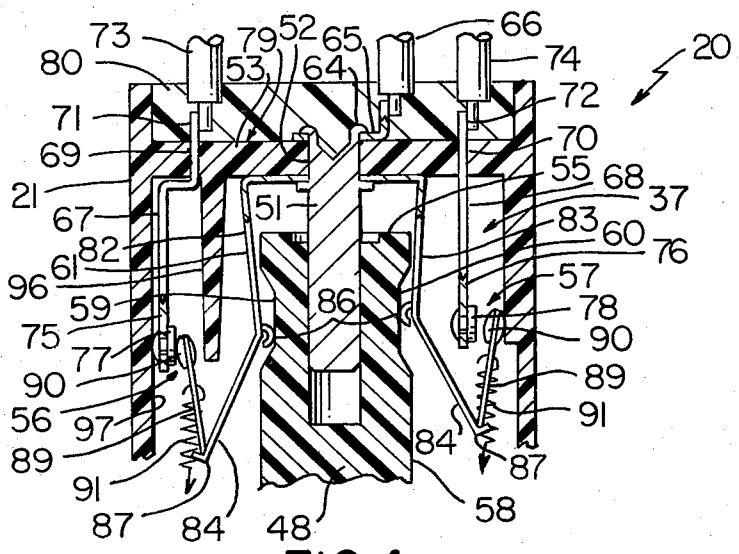
FIG. 4 is a fragmentary view similar to FIG. 3 and illustrates the pneumatically operated switch construction in still another operating condition thereof.

The axial movement of the plunger means 49 by the diaphragm 28 is guided by a cylindrical guide member 51 being secured in an opening 52 in an end wall 53 of the cup-shaped housing part 22 and projecting into a cylindrical opening 54 formed in the plunger means 48 and interrupting the end 55 thereof as illustrated. In this manner, as the plunger means 48 is moved downwardly and upwardly in the drawings as illustrated in FIGS. 3, 4 and 5, the stationary guide member 51 guides such axial movement of the plunger means 48.

The plunger means 48 is adapted to serially operate a pair of electrical switches of the construction 20 that are respectively generally indicated by the reference numerals 56 and 57 and which form part of the electrical switch means or portion 37 of the pneumatically operated electrical switch construction 20 of this invention.

In particular, the plunger means 48 has a substantially cylindrical outer peripheral portion or surface means 58 interrupted by a pair of opposed and offset cam surfaces or recess means 59 and 60 for respectively operating the electrical switches 56 and 57 in a serial manner as hereinafter set forth.

Figure 8:
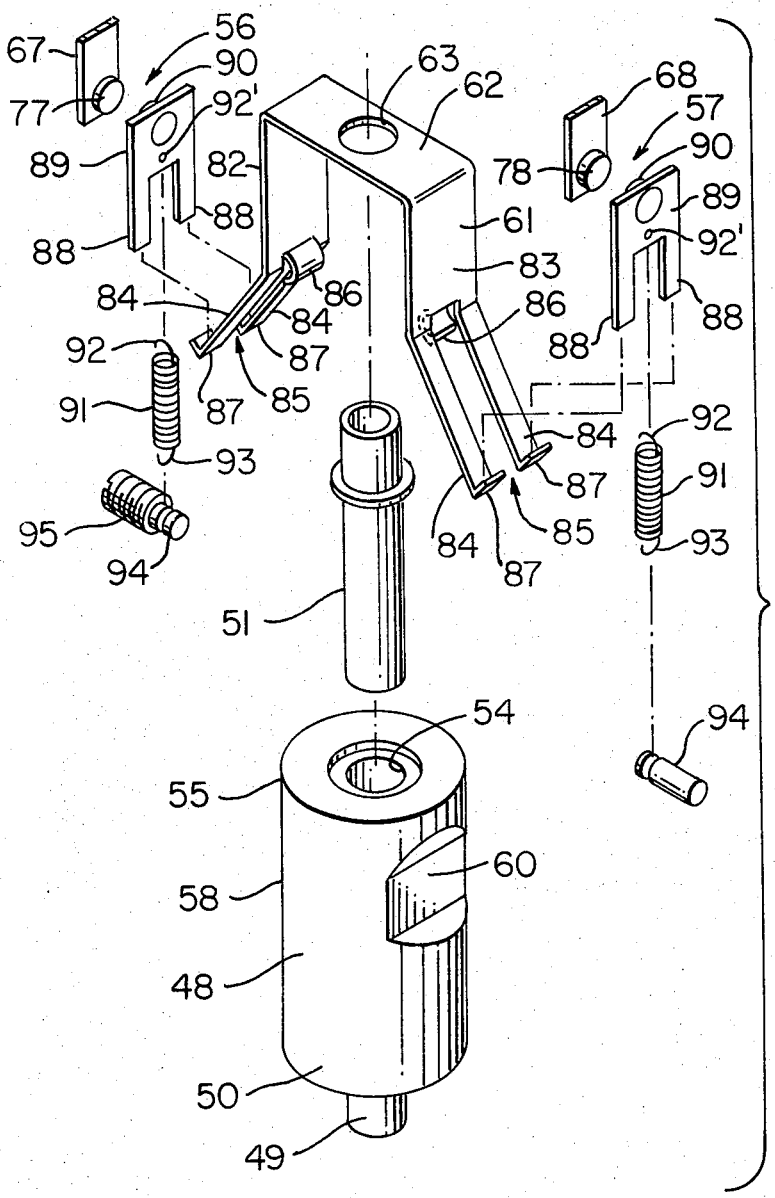
FIG. 8 is an exploded perspective view of certain parts of the pneumatically operated electrical switch construction of FIG. 2.

As illustrated in FIGS. 2 and 8, a U-shaped metallic member 61 has its cross member 62 provided with an opening 63 therethrough and through which the guide member 51 projects to secure the cross member 62 to the end wall 53 of the housing part 22 as illustrated in FIG. 2. The guide member 51 is formed of metallic material and has its end 64 clamping against a terminal 65 which is adapted to be electrically interconnected to a lead 66 as illustrated whereby the lead 66 is electrically interconnected to the U-shaped member 61 by the stationary conductive guide post or member 51.

A pair of rigid conductive terminal members 67 and 68 project through suitable opening means 69 and 70 in the end wall 53 of the housing part 22 so that the upper ends 71 and 72 of the terminal members 67 and 68 can be electrically interconnected to a pair of leads 73 and 74, the other ends 75 and 76 of the terminal members 67 and 68 projecting into the chamber 29 of the housing means 21 and respectively carrying fixed contacts 77 and 78 that respectively form part of the electrical switches 56 and 57 in the manner hereinafter set forth.

When the leads 66, 73 and 74 have been respectively electrically interconnected to the terminal parts 65, 71 and 72, such as by soldering and the like, the cup-shaped cavity 79 of the housing part 22 is filled with suitable potting material 80, such as an epoxy resin, which when set, completely insulates the interconnecting portions of the leads 66, 73 and 74 to the terminal parts 55, 71 and 72 from the exterior of the housing means 21 as illustrated, the leads 66, 73 and 74 being interconnected to an electrical socket member 81 for subsequent plugging into a desired electrical circuit means in a manner well known in the art.

The U-shaped member 61 has a pair of legs 82 and 83 respectively extending from the opposed ends of the cross member 62 thereof with the legs 82 and 83 being suitably slotted to define a pair of pivot members 84 at each end thereof separated from each other by the slot means 85. The end of the slot means 85 for each leg 82 and 83 is provided with an arcuate tang 86 carved from the respective leg 82 or 83 which respectively are adapted to bear against the external peripheral surface 58 of the plunger means 48 as the legs 82 and 83 have a natural tendency to be biased inwardly relative to the plunger means 48. In this manner the cam followers 86 will respectively ride into the cam recesses 59 and 60 when the plunger means 48 is aligned therewith as will be apparent hereinafter and thereby will permit the pivot ends 84 of the legs 82 and 83 to likewise move inwardly toward the plunger means 48.

Each pivot member 84 is bent into an L-shaped configuration to define a V-section 87 in which a leg 88 of a movable switch blade 89 is adapted to be received, the movable switch blades 89 respectively carrying contacts 90 that cooperate with the respective fixed contacts 77 and 78 of the respective switch means 56 and 57 in a manner hereinafter set forth.

A tension spring 91 for each switch blade 89 has one end 92 interconnected to the switch blade 89 intermediate the legs 88 thereof by being received in an opening 92' formed therein and has the other end 93 thereof looped around a post means 94 carried by the housing part 22, the post means 94 for the switch means 57 being fixed whereas the post means 94 for the switch means 56 has an externally threaded portion 95 disposed in a threaded opening 96' in the housing part 22 so that the switch means 56 can be adjusted as hereinafter set forth.

In this manner, the tension springs 91 hold the ends 88 of the switch blades 89 in their respective V-notches 87 of the legs 82 and 83 so that the switch blades 89 are pivotally mounted and will be snap acting as hereinafter set forth.

The housing part 22 of the housing means 21 of the pneumatically operated electrical switch construction 20 of this invention is provided with a stop member 96 that extends inwardly from the end wall 53 of the housing part 22 and is integral therewith, the stop part 96 providing a stop against which the movable contact 90 of the electrical switch 56 can be disposed when the same is held out of contact with the fixed contact 77 by the tension spring 91 as illustrated in FIG. 2.

Similarly, the housing part 22 is provided with an internal surface 97 against which the movable contact 90 of the switch means 57 can be moved in the manner illustrated in FIG. 3 by the tension spring 91 to hold the movable contact 90 out of contact with the fixed contact 78 as will be apparent hereinafter.

Therefore, it can be seen that the pneumatically operated electrical switch construction 20 of this invention can be formed from a relatively few parts in a unique manner to operate in a manner now to be described.

Assuming that the no vacuum signal is being directed to the chamber 30 of the pneumatically operated electrical switch construction 20 so that the force of the compression spring 38 has moved the flexible diaphragm 28 upwardly until the end 55 of the plunger means 48 is bottomed out against the cross member 62 of the U-shaped member 61 as illustrated in FIG. 2. In this condition of the construction 20, the peripheral surface 58 of the plunger means 48 has spread apart the legs 82 and 83 of the conductive member 61 against the natural bias of the legs 82 and 83 in such a manner that the pivot parts 84 of the leg 82 in cooperation with its tension spring 91 hold the movable switch blade 89 of the switch 56 in its open condition with the movable contact 90 against the stop 96 so that the switch construction 56 is normally in its open condition. Conversely, the pivot portions 84 of the leg 83 in cooperation with its tension spring 91 hold the movable contact 89 of the switch 57 in its closed condition by holding its movable contact 90 against the fixed contact 78 of the switch means 57 so that the switch means 57 is normally in its closed condition.

However, as the vacuum source 32 is permitted to begin to evacuate the chamber 30, the resulting pressure differential now acting across the diaphragm 28 tends to move the diaphragm 28 downwardly in the drawings in opposition to the force of the compression spring 38. In this manner, when a certain vacuum signal is reached in the chamber 30, the diaphragm 28 has been moved downwardly sufficiently in the manner illustrated in FIG. 3 so that the cam guide 86 of the leg 83 has been moved into the cam recess 60 of the plunger means 48 a sufficient distance whereby the pivot parts 84 of the leg 83 in cooperation with its tension spring 91 has moved the tension spring 91 over center to cause the switch blade 89 of the switch means 57 to snap outwardly and move the movable contact 90 thereof away from the fixed contact 78 and against the stop 97 as illustrated so that the switch 57 is now in an open condition.

Subsequently, further downward movement of the diaphragm 28 upon a further increase in the vacuum signal being directed into the chamber 30 can continue until another certain vacuum level is reached at which time the cam follower 86 of the leg 82 is now received into the cam recess 59 in the manner illustrated in FIG. 4 so that the pivot members 84 of the leg 82 in cooperation with its tension spring 91 snaps the switch blade 89 of the switch means 56 to move the movable contact 90 thereof into contact with the fixed contact 77 to thereby close the switch 56 in the manner illustrated in FIG. 4, the switch 57 remaining in the open position as the cam follower 86 of the leg 83 is still within the cam recess 60.

However, when a third vacuum level is reached in the chamber 30, the diaphragm 28 has been moved down sufficiently that the plunger means 48 now acts on the cam follower 86 on the leg 83 to cam the same outwardly in the manner illustrated in FIG. 5 so that the switch blade 89 thereof snaps in a direction to have its movable contact 90 placed back into contact with the fixed contact 78 to thereby close the switch 57 as illustrated in FIG. 5, the switch means 56 remaining in its closed condition in the manner illustrated in FIG. 5 at this time because the cam follower 86 of the leg 82 is still within the cam recess 59 as illustrated.

Therefore, it can be seen that the unique plunger means 48 of this invention is adapted to serially operate the electrical switches 56 and 57 at different predetermined vacuum signals that are being received in the vacuum operated device 31 of the pneumatically operated electrical switch construction 20 of this invention.

Obviously, as the vacuum signal in the chamber 30 decreases in value from the previously described sequence, the resulting upward movement of the plunger means 48 causes the switch means 56 and 57 to open and close in a reverse manner from that previously described.

Of course, the switch means 56 could be further operated from the condition illustrated in FIG. 5 by further downward movement of the plunger means 48 to cause the switch means 56 to again open whereby the four switching operations can be provided by the two switch means 56 and 57 rather than just the three switching operations illustrated in the drawings.

In order to calibrate the pneumatically operated electrical switch construction 20 of this invention to operate in the above manner at the proper vacuum signals in the chamber 30, the adjusting member 43 can adjust the force of the spring 38 to make sure that the switch 57 opens in the manner illustrated in FIG. 3 when a first predetermined vacuum signal is being imposed in the chamber 30. Thereafter, the adjustable post 94 for the switch 56 is adjusted to make sure that the switch 56 will close as illustrated in FIG. 4 when a second predetermined vacuum signal is being imposed in the chamber 30.

From the above, it can be seen that an improved pneumatically operated electrical switch construction 20 of this invention is provided and the same is adapted to sequentially operate electrical switches in substantially the same manner as the temperature responsive electrical switch construction of the afore-mentioned copending parent patent application, Ser. No. 187,498, filed Sept. 15, 1980.

Figure 9:
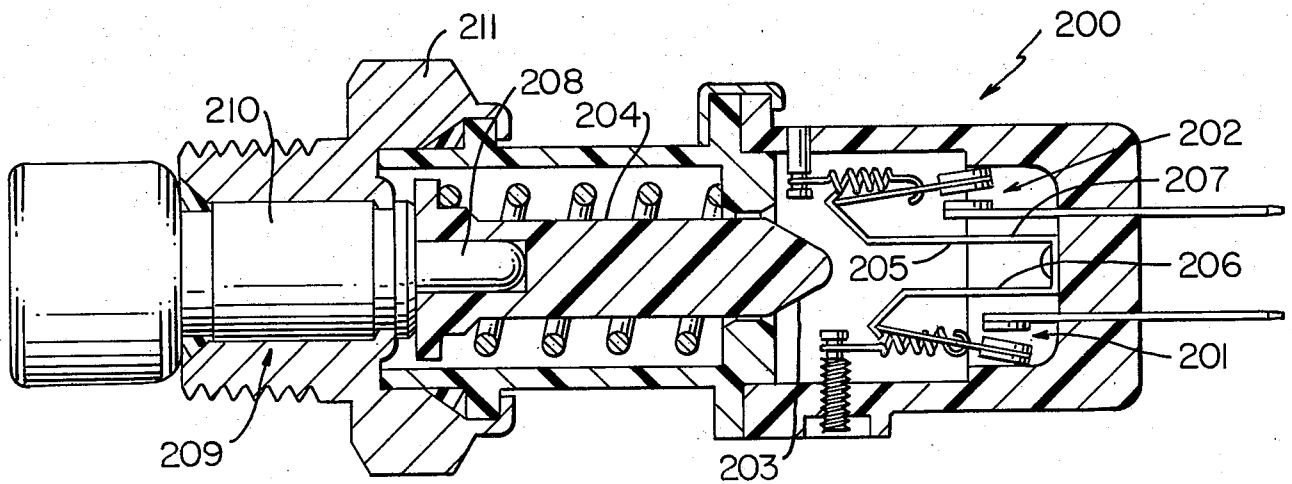
FIG. 9 is a cross-sectional view illustrating the temperature responsive electrical switch construction of applicant's copending parent patent application, Ser. No. 187,498, filed Sept. 15, 1980.

In particular, such temperature responsive electrical switch construction is generally indicated by the reference numeral 200 in FIG. 9 and comprises a pair of electrical switches 201 and 202 formed substantially identical to the electrical switches 56 and 57 of the construction 20 previously described, except that the same are operated by a cam end 203 of a plunger means 204 that is moved between the legs 205 and 206 of a U-shaped conductive member 207 that is similar to the U-shaped member 61 of the construction 20 previously described. The plunger means 204 is moved by a piston member 208 of a piston and cylinder type thermal device 209 that has its cylinder 210 carried by the housing means 211 of the temperature responsive electrical switch construction 200 so that the switches 201 and 202 can be operated serially by the plunger means 204 as the thermal device 208 senses different predetermined temperatures as fully set forth in the copending parent patent application, Ser. No. 187,498, filed Sept. 15, 1980.

Therefore, it can be seen that this invention not only provides an improved electrical switch construction, but also this invention provides a method of making such an electrical switch construction.

While the form and method of this invention now preferred has been illustrated and described as required by the Patent Statute, it is to be understood that other forms and method steps can be utilized and still fall within the scope of the appended claims.

What is claimed is:

1. In an electrical switch construction having electrical contact means operated by an axially movable plunger means of a device carried by said construction, said contact means comprising a plurality of pairs of cooperating contacts arranged to have each cooperating pair thereof operated by said plunger means as said device axially moves said plunger means in one direction, each said pair of cooperating contacts comprising a fixed contact and a movable contact, each movable contact being snap-acting, each movable contact having a pivot member pivotally mounted to said construction, a one-piece substantially U-shaped flexible member having a cross member and a pair of legs extending from said cross member and defining pivot means that pivotally mount said pivot members to said construction, the improvement wherein said legs respectively have cam follower means intermediate said pivot means thereof and said cross member, said plunger means being axially movable between said legs and having cam means serially engageable with said follower means to serially flex said legs and thereby move said pivot means thereof to cause said pivot members to serially pivot as said plunger means is axially moved by said device in said one direction.

2. An electrical switch construction as set forth in claim 1 wherein each movable contact has a tension spring provided with opposed ends, one of said ends of each tension spring being interconnected to its respective pivot member and the other of said ends thereof being interconnected to said construction.

3. An electrical switch construction as set forth in claim 2 wherein one of said springs has an adjustable member interconnecting said other end thereof to said construction.

4. An electrical switch construction as set forth in claim 2 wherein said plunger means causes said springs to serially be overcenter and operate said pivot members to serially operate said pairs of contacts when said plunger means serially flexes said legs.

5. An electrical switch construction as set forth in claim 4 wherein said legs respectively have free ends, said pivot means for each leg being substantially at said free end thereof.

6. An electrical switch construction as set forth in claim 5 wherein said legs are of different length.

7. An electrical switch construction as set forth in claim 1 wherein said plunger means has a peripheral side surface, said cam means of said plunger means forming part of said peripheral side surface.

8. An electrical switch construction as set forth in claim 1 wherein said device has a flexible diaphragm means carried by said construction, said plunger means being interconnected to said diaphragm means to move in unison therewith.

9. An electrical switch construction as set forth in claim 8 wherein said construction has guide means operatively associated with said plunger means to guide the movement of said plunger means relative to said construction.

10. An electrical switch construction as set forth in claim 9 wherein said guide means comprises a rod carried by said construction, said plunger means having an opening therein telescopically receiving said rod to be guided thereby.

11. An electrical switch construction as set forth in claim 8 wherein said device is vacuum operated.

12. An electrical switch construction as set forth in claim 11 and including a compression spring carried by said construction and acting on said diaphragm means to tend to move said plunger means in one direction.

* * * * *